US011071381B2

(12) United States Patent
Held

(10) Patent No.: US 11,071,381 B2
(45) Date of Patent: Jul. 27, 2021

(54) FASTENING FITTING FOR A PANEL

(71) Applicant: Wolfgang Held, Hard (AT)

(72) Inventor: Wolfgang Held, Hard (AT)

( * ) Notice: Subject to any disclaimer, the term of this patent is extended or adjusted under 35 U.S.C. 154(b) by 0 days.

(21) Appl. No.: 16/611,108

(22) PCT Filed: May 9, 2018

(86) PCT No.: PCT/EP2018/062145

§ 371 (c)(1),
(2) Date: Nov. 5, 2019

(87) PCT Pub. No.: WO2018/206727

PCT Pub. Date: Nov. 15, 2018

(65) Prior Publication Data

US 2020/0054132 A1 Feb. 20, 2020

(30) Foreign Application Priority Data

May 10, 2017 (EP) ..... 17170432

(51) Int. Cl.
*A47B 88/956* (2017.01)
*A47B 88/90* (2017.01)
*A47B 88/95* (2017.01)

(52) U.S. Cl.
CPC ..... *A47B 88/956* (2017.01); *A47B 88/941* (2017.01); *A47B 2088/952* (2017.01)

(58) Field of Classification Search
CPC ..... A47B 88/956; A47B 88/941; A47B 2088/952
See application file for complete search history.

(56) References Cited

U.S. PATENT DOCUMENTS

| | | | | |
|---|---|---|---|---|
| 4,995,683 | A * | 2/1991 | Albiez | A47B 88/956 312/348.4 |
| 6,412,893 | B1 * | 7/2002 | Muterthies | A47B 88/941 312/330.1 |
| 6,457,791 | B1 * | 10/2002 | Muterthies | A47B 88/956 312/330.1 |
| 9,185,976 | B2 * | 11/2015 | Chen | A47B 88/956 |
| 9,752,817 | B2 * | 9/2017 | Richards | F25D 23/028 |
| 10,010,174 | B2 * | 7/2018 | Chen | A47B 88/95 |
| 10,188,209 | B2 * | 1/2019 | Hoffmann | A47B 88/95 |
| 10,342,343 | B2 * | 7/2019 | Su | A47B 88/941 |

(Continued)

FOREIGN PATENT DOCUMENTS

| | | | | |
|---|---|---|---|---|
| JP | 04253809 A * | 9/1992 | | A47B 88/941 |
| WO | WO-2012055156 A1 * | 5/2012 | | A47B 88/956 |

*Primary Examiner* — Hanh V Tran
(74) *Attorney, Agent, or Firm* — John Alumit

(57) ABSTRACT

The invention relates to a fastening fitting for a drawer panel, wherein the panel carries aligned panel mounting parts (2, 2', 2") on its rear side and the lateral walls of the drawer carry panel fitting parts (1, 1') which receive the panel mounting parts (2, 2', 2"), which panel mounting parts and panel fitting parts can be operatively connected using a fixing means (7, 7'). The panel mounting parts (2, 2', 2") have means (4, 4', 8) for adjusting the inclination of the panel, said means being operatively connected to adjustment bodies (5. 5') of the panel fitting parts (1, 1') and pivoting the panel about an axis running perpendicularly to the base side or cover side of the drawer.

10 Claims, 6 Drawing Sheets

(56) References Cited

U.S. PATENT DOCUMENTS

Figures 1, 2:
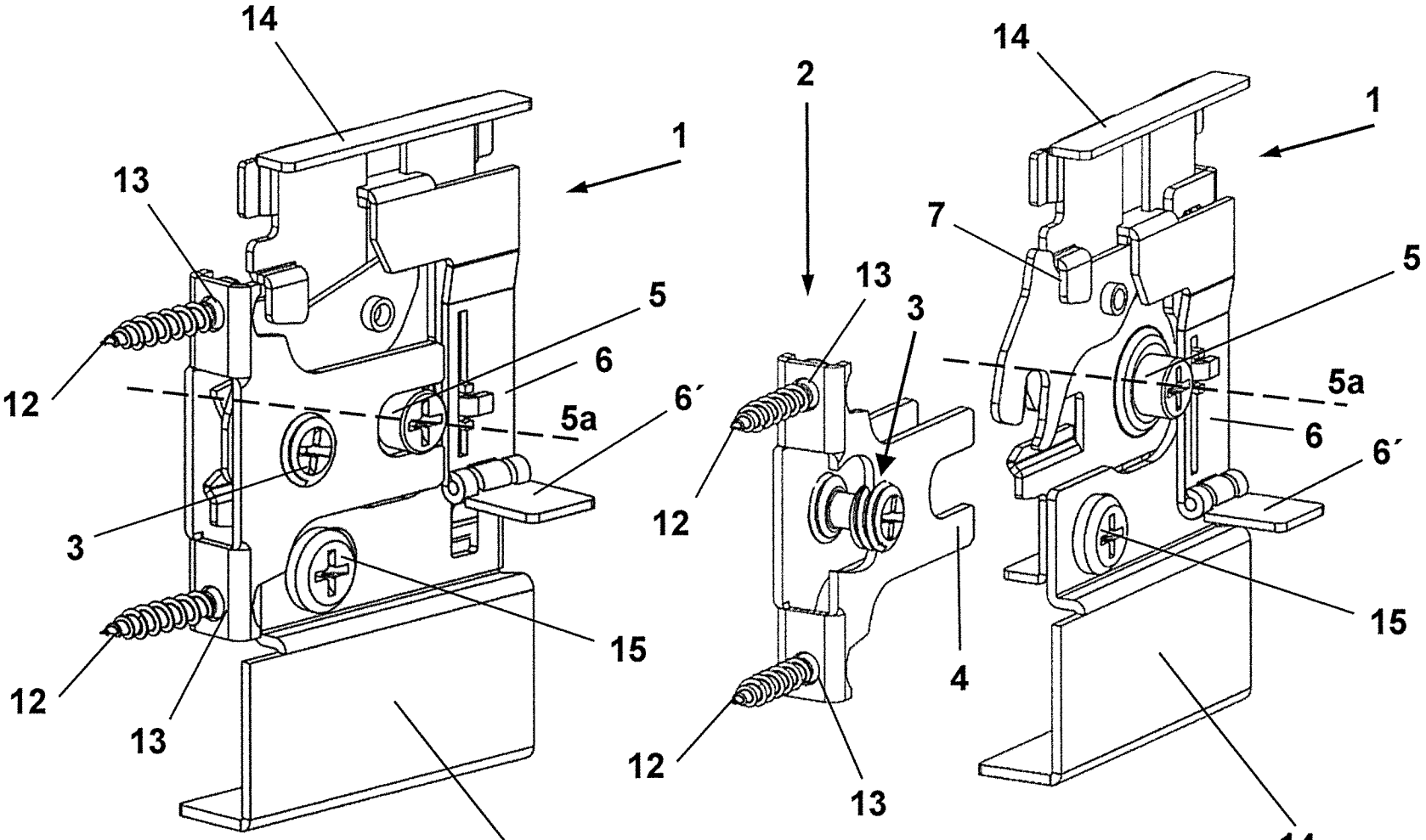

| | | | | |
|---|---|---|---|---|
| 10,550,882 | B2 * | 2/2020 | Chen | F16C 29/004 |
| 10,568,427 | B2 * | 2/2020 | Kruger | A47B 88/941 |
| 10,660,437 | B2 * | 5/2020 | Prentner | F16H 25/18 |
| 2012/0286116 | A1 * | 11/2012 | Gasser | A47B 88/956<br>248/221.11 |
| 2013/0257252 | A1 * | 10/2013 | Holzapfel | A47B 88/956<br>312/348.4 |
| 2014/0072366 | A1 * | 3/2014 | Holzapfel | F16B 12/02<br>403/326 |
| 2014/0077677 | A1 * | 3/2014 | Holzapfel | A47B 88/956<br>312/348.4 |
| 2014/0077678 | A1 * | 3/2014 | Holzapfel | A47B 88/956<br>312/348.4 |
| 2014/0252936 | A1 * | 9/2014 | Holzapfel | A47B 88/956<br>312/348.4 |
| 2014/0312756 | A1 * | 10/2014 | Ng | A47B 88/407<br>312/334.5 |
| 2018/0168343 | A1 * | 6/2018 | Held | A47B 88/95 |

* cited by examiner

FASTENING FITTING FOR A PANEL

The invention relates to a fastening fitting for a panel on an open face end of a drawer, as defined by the preamble to claim 1.

One such panel fitting part is known from DE 20 2014 002 229 U1 and has a panel which, on its back side, has two mounting parts, aligned with the outer sides of the side walls of the drawer, and the side walls of the drawer have two fittings that receive the panel mounting parts; the panel mounting parts can be fixed in the fittings. The panel fitting part and the panel mounting parts have further features, which are:

The panel fittings have a coupling bolt, located spaced apart from the back side of the panel and oriented horizontally; the panel fastening parts of the drawer have fixing means which are rotatable and limitedly displaceable horizontally, with a guide slit for receiving coupling bolts of the panel mounting parts; upon attachment of the panel, the coupling bolts are aligned with the insertion openings of the guide slits of the fixing means, and upon further insertion of the coupling bolts into the fittings of the drawer, the fixing means can be put rotatably and horizontally displaceably into a final and connection position, and in the connection position, the panel rests with its back side on the face end of the drawer, and the coupling bolts of the panel mounting parts are fixed nondetachably in the fittings of the drawer in the connection position.

EP 0 323 822 teaches a drawer with a set of pull-out fittings which has a front plate with retention angles which are adjustable in height via eccentrics relative to the case of the drawer. However, the fixing means of the invention, which are secured so that they cannot be opened by simply rotating them, are not taught by this reference.

WO 2010/136228 A1 also teaches a drawer arrangement having an eccentric for adjusting the orientation of the front plate relative to the cases; a connection between the front plate and the case is furnished by a clamp system, which engages a two-piece receptacle in the front plate. By contrary rotary motion of the two arms of the clamp system, a connection between the front fitting and the case can be released. A translational motion of fixing means for releasing a connection with a bolt, however, is not disclosed.

In this known panel fastening and panel mounting part, it has been found that it would be desirable, going beyond the achieved, simple horizontal adjustability and vertical adjustability of the panel, to achieve a simple adjustability of the inclination of the panel. It is therefore the object of the invention to further refine a fastening in such a way that the panel can be attached to the drawer and fixed without doing manual mounting work and with an angle of inclination, or in other words simply by attaching it.

This object is attained by the features of claim 1.

According to the invention, q fastening fitting for a drawer panel is provided, in which the panel on its back side has aligned panel mounting parts, and the side walls of the drawer have panel fitting parts that receive the panel mounting parts, which are connectable by means of fixing means of the panel fitting parts and fastening bolts of the panel mounting parts; the panel mounting parts have means for adjusting the inclination of the panel, which means are operatively connected to adjusting bodies of the panel fitting parts and pivot the panel about an axis that extends parallel to the base or cover side of the drawer, and the fastening bolts are each located displaceably in a guide portion and are movable along the guide portion between an open position of the fastening bolts and a closed position of the fastening bolts.

In a fundamental concept of the present invention, a panel fitting part is provided, which has means for adjusting the inclination and/or has at least one guide portion, in which a fastening bolt is movably supported. Accordingly, the inclination can be adjusted and the features relating to the guide portion and its movable arrangement can be realized independently of one another.

According to the invention, fastening bolts are all those elements and means which are suited to forming a connection with a counterpart element on a drawer panel. In particular, the fastening bolt can be a catch hook.

In this way, the assembly with regard to the inclination adjustment of the panel can be achieved with a simple, aligned joining together of the panel mounting parts and the fittings of the drawer.

In an advantageous embodiment of the invention, the panel mounting part has apertures toward the panel, by means of which apertures it can be connected to the panel, for instance via screws or snap-in bolt connections.

In a further advantageous feature of the invention, the panel mounting part can be adjusted vertically relative to the panel fitting part by means of an adjusting body embodied as an eccentric bolt.

In a further advantageous feature of the invention, the panel mounting part is adjustable horizontally relative to the panel fitting part by means of a screw connection.

A further advantageous feature of the invention permits a snap-in connection of the panel mounting part to the panel fitting part by means of a fastening bolt, supported in the panel mounting part, that snaps into a movable, spring-loaded and snap-in fixing means of the panel fitting part by means of being displaced horizontally one inside the other and can be released via a tripping element with an openable actuation part counter to the spring force; the fixing means has a slit part, which in the released state is aligned with a horizontal slit in the fitting, and the fastening bolt, during the connection process, can be displaced horizontally into both slits, and in the locked state, the slit of the fixing means is rotated relative to the slit of the fitting and prevents the catch bolt from being displaced out of the fixing means. Preferably, the fixing means can be embodied in hooklike fashion.

In a further feature of the invention, the panel fitting part has angled regions, which enable a simple connection with a signed part of the drawer, and the connection can be secured by means of screws, rivets, snap-in or compressible bolts, etc. It is especially preferably provided that at least one tripping element is provided on the panel fitting part in order to release the connection between the fixing means and the panel mounting part.

Preferably, it is provided that the panel fitting part has at least two fixing means, and the individual fixing means can be released by means of separate tripping elements.

In a further feature of the invention, it is especially expedient that by actuating a single tripping element on a panel fitting part, the connections between at least two panel mounting parts and the respective catch parts of the panel fitting part can be released; an uncoupling device is operatively connected to the tripping element and is embodied for releasing the individual connection between catch parts and mounting parts in delayed fashion, or in a chronologically offset manner to one another.

Further advantageous features can be learned from the dependent claims.

Figure 3:
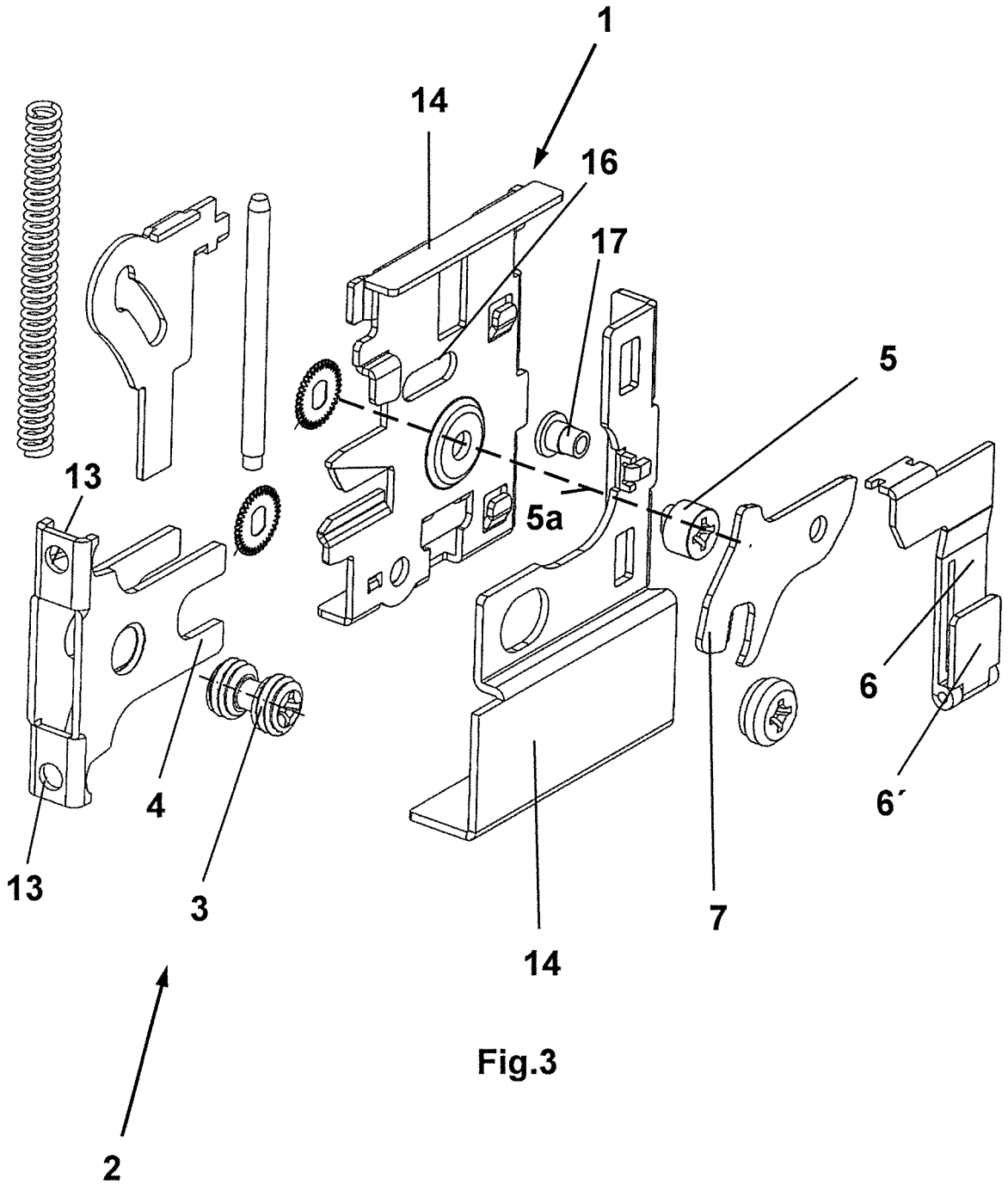
Figure 4:
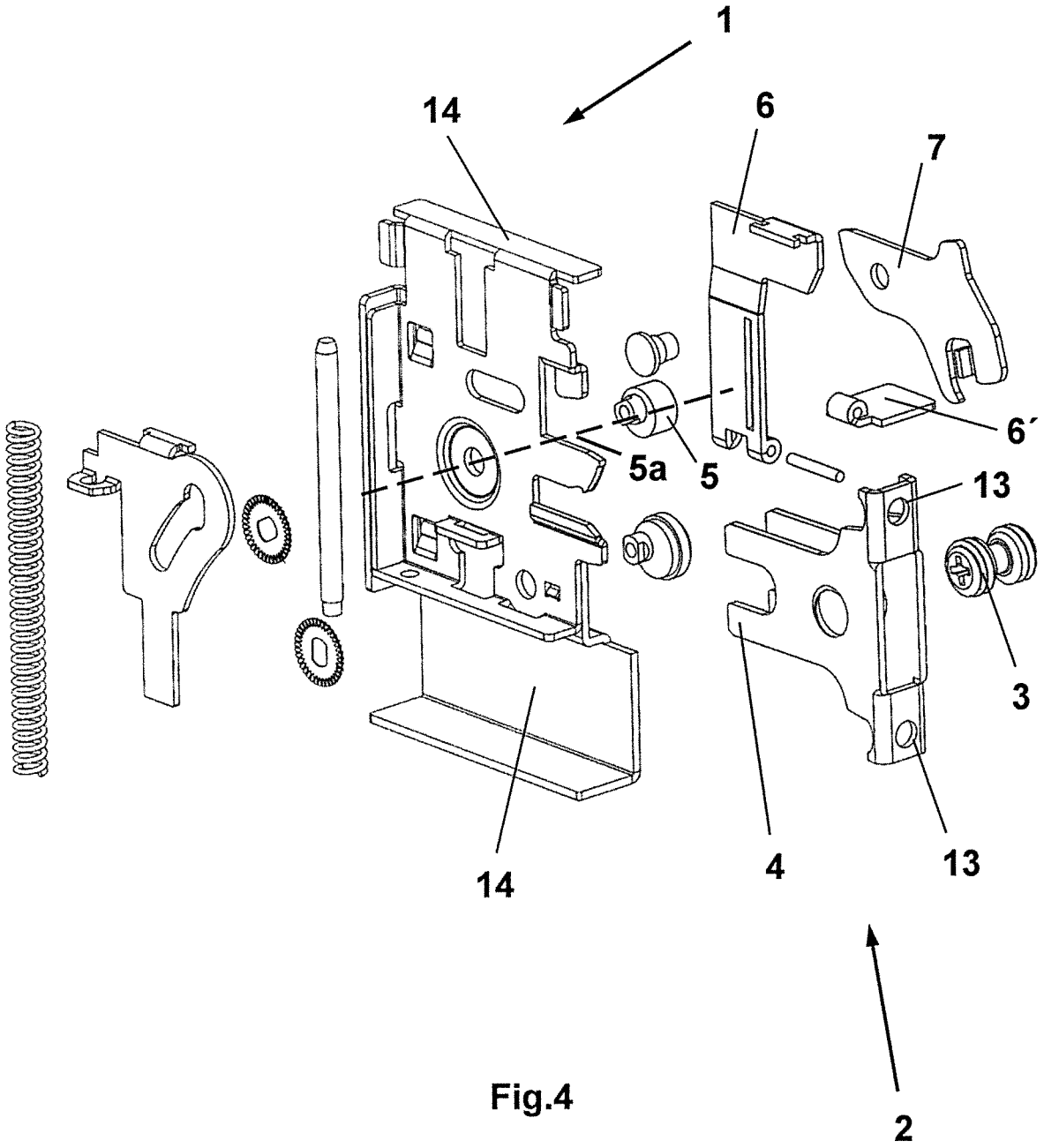
Figure 5:
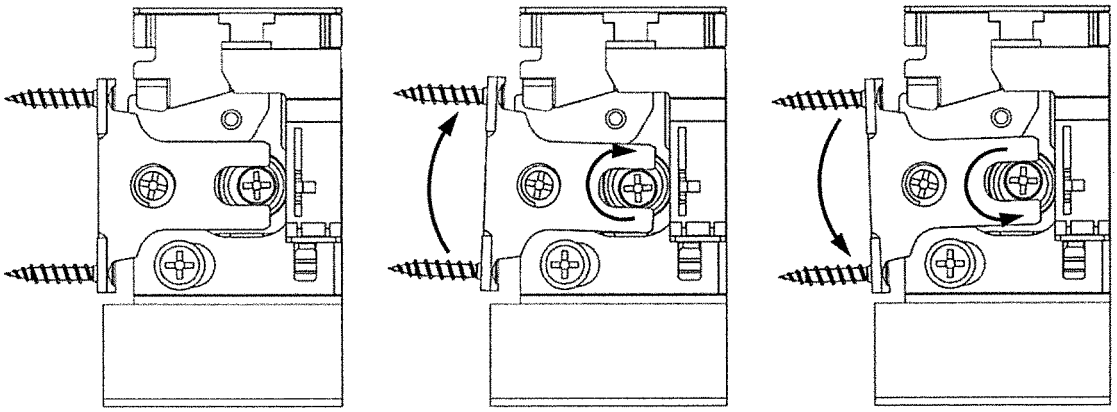
Figure 8:
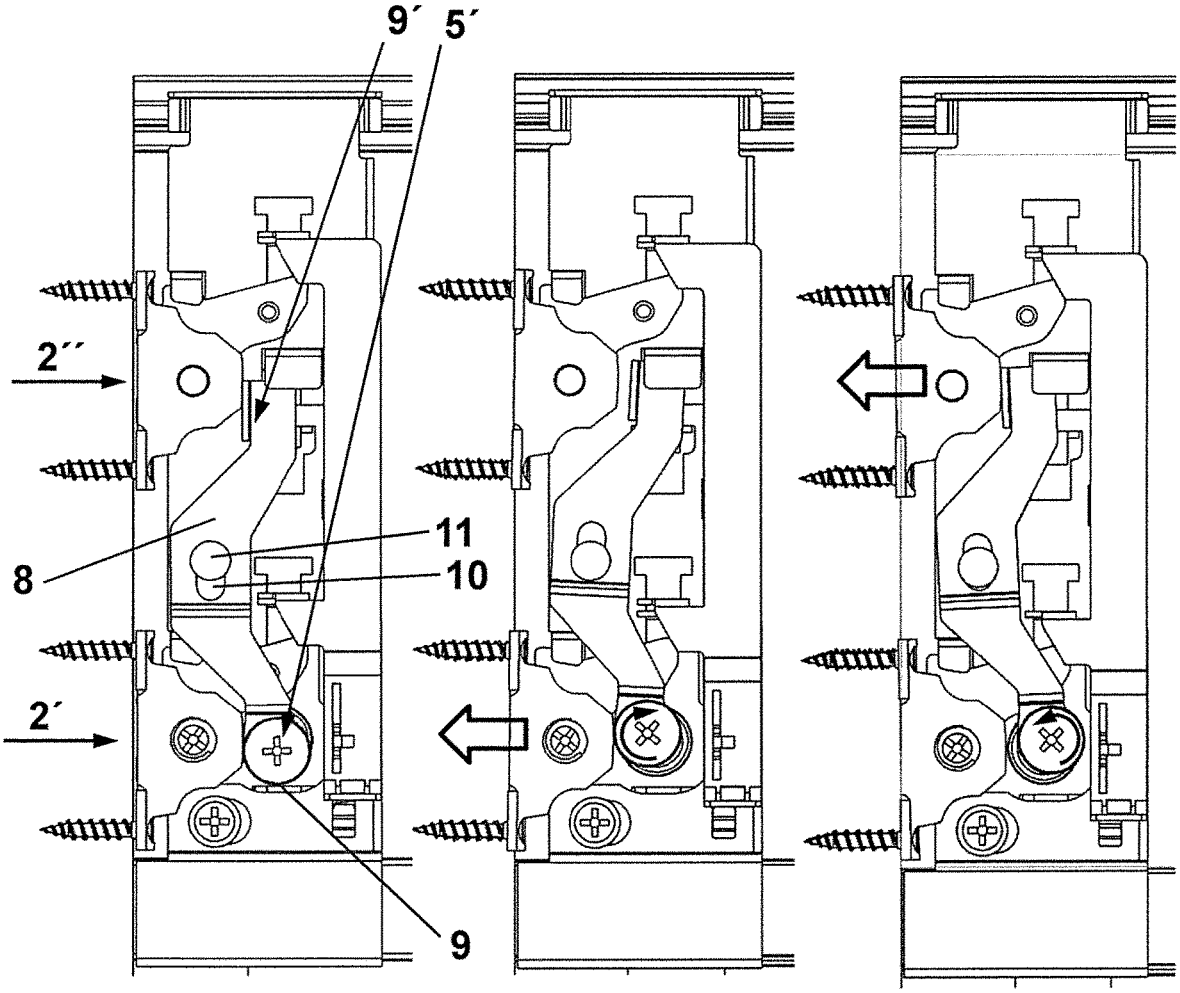
Figure 6:
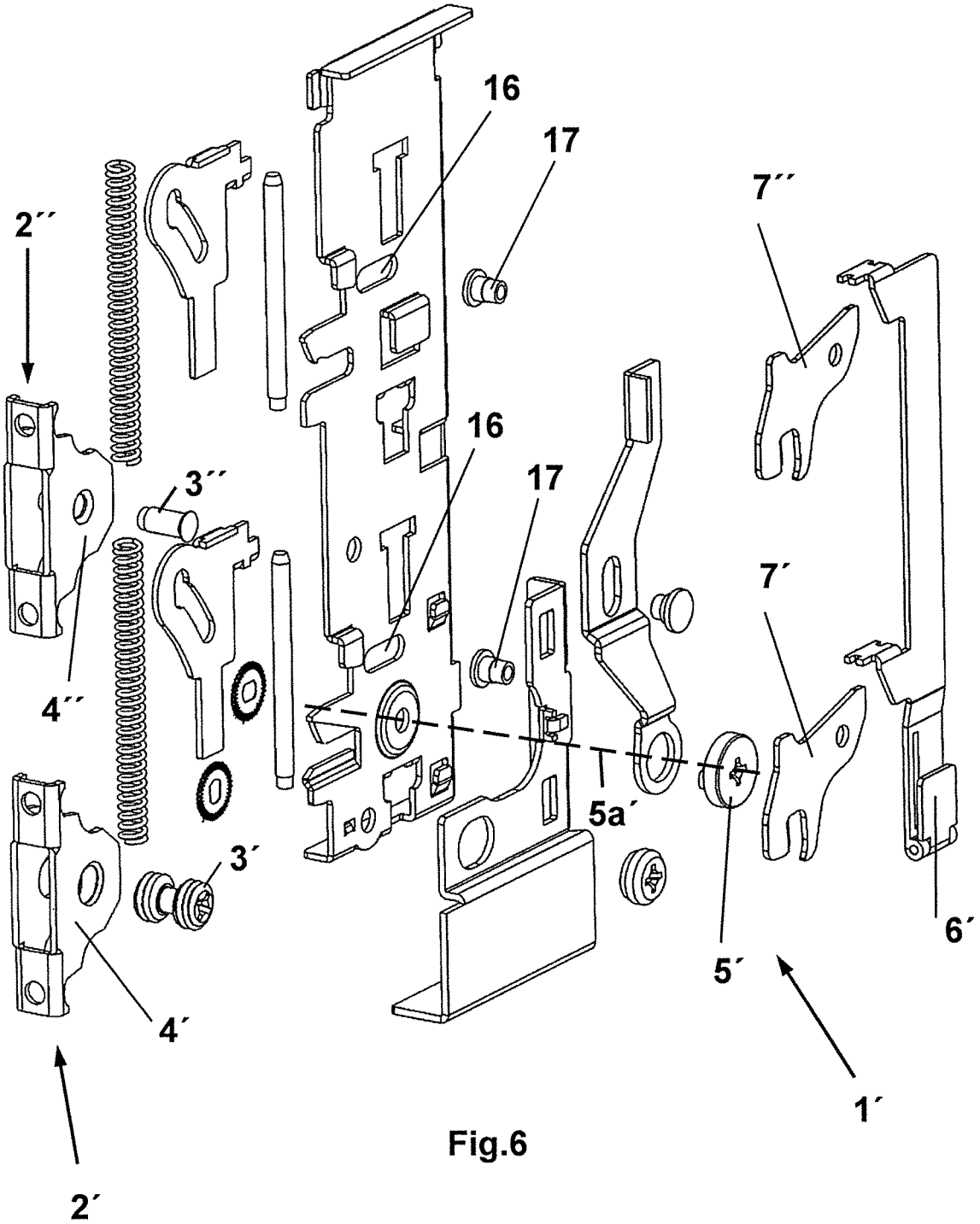

The invention will now be described in further detail in terms of exemplary embodiments shown in the accompanying drawings. In the drawings:

FIGS. 1+2 show a perspective view of a panel fitting part and a panel mounting part in the put-together and separate state;

FIGS. 3+4 show the panel fitting part and panel mounting part in an exploded view in a first and second perspective view;

FIG. 5 shows a panel fitting and mounting part of FIG. 1 with three different inclined face ends in the put-together state and in side view;

FIGS. 6+7 show a side view of a panel fitting part and of the panel mounting parts for tall drawers, in an exploded view in a first and second perspective view;

FIG. 8 shows the panel fitting part and the panel mounting parts of FIG. 6 in the put-together state and in a side view.

In FIG. 1, a panel fitting part 1 is shown for a drawer, not shown; the view is aimed at the securing side that faces toward the side wall of the drawer. The panel fitting part 1, for easy connection with the side part of the drawer, has angled regions 14, and the connection can be secured by means of screws, rivets, snap-in or compressible bolts, etc. A panel mounting part 2 connected to the panel fitting part 1 is screwed to the back side of the drawer via bores 13 in the mounting part 2 and corresponding screws 12 or snap-in bolt connections. A fastening bolt 3 of the panel mounting part 2 connects the latter to the fixing means 7 of the panel fitting part 1 at a given spacing from the back side of the panel. The panel of the drawer has two such panel mounting parts 2, which are connected to corresponding panel fitting parts 1, at a spacing which is adapted to the dimensions of the outsides of the two side walls of the open face end of the drawer.

FIG. 1 also shows two shanks of a fork 4 of the panel mounting part 2, which fork is oriented toward the panel fitting part 1, and the panel mounting part encases an adjusting body 5 embodied as an eccentric bolt. By rotating this adjusting body about its axis 5*a*, the location of the fork 4 can be pivoted about the fastening bolt 3 and thus the inclination of the panel can be varied, for instance by means of a Phillips-type screwdriver. A tripping element 6 is also shown, which upon actuation, in a manner not shown here but shown in DE 20 2014 002 229 U1, separates the two parts 1, 2 from one another. This tripping element 6 can be embodied with an actuation part 6' that can be swung open.

FIG. 2 shows the fastening bolt 3, which is preferably rotatable and/or horizontally displaceable, which engages a fixing means 7 of the panel fitting part 1. Means can also be present for vertical and horizontal adjustment of the panel. With the aid of an adjusting body 15, which is embodied as an eccentric bolt and is supported in an appropriate opening of the panel fitting part 1 and is connected to a movable part of the panel fitting part, the panel mounting part 2 and thus the panel are vertically adjustable relative to the panel fitting part 1. With the aid of a screw connection of the fastening bolt 3 to the panel mounting part 2, the panel mounting part 2 is horizontally adjustable relative to the panel fitting part 1, and the fastening bolt 3 has a smaller diameter in its interior region and a larger diameter at its two outer regions, and the contact faces of the outer regions are operatively connected to the receiving fixing means 7 of the panel fitting part 1 and are also operatively connected to the panel fitting part 1 and effect the horizontal adjustment.

In FIGS. 3+4, the panel fitting part and the panel mounting part can be seen in an exploded view, in a first and second perspective view.

FIG. 5 shows a panel fitting part of FIG. 1 with three different inclined face ends:

perpendicular
inclined upward
inclined downward.

Figure 7:
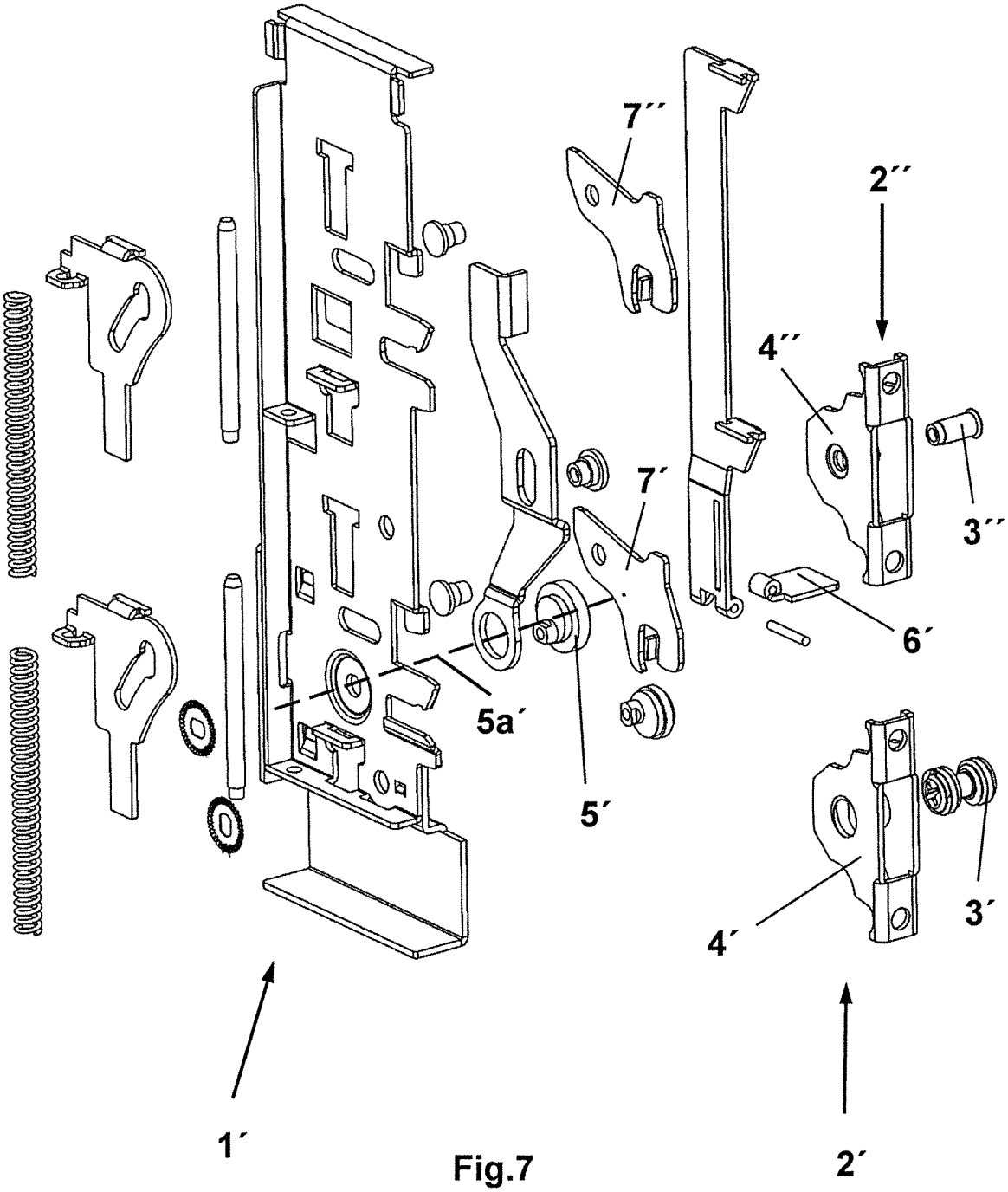

For tall drawers, the embodiment shown in FIGS. 6, 7 and 8 is advantageous.

On its back side, the panel according to FIGS. 6 through 8 has aligned panel mounting parts 2', 2" for each side part/case, and the side walls of the drawer have panel fitting parts 1', each receiving the panel mounting parts 2', 2", and these panel fitting parts are operationally connectable by fixing means 7', 7" of the panel fitting part 1' and by fastening bolts 3', 3"' of the panel mounting parts 2', 2". Each panel fitting part is thus connected to at least two mounting parts 2', 2". The panel mounting parts 2, 2' and the panel fitting parts 1' have means 4', 4", 8 for adjusting the inclination of the panel, which means are operatively connected to adjusting bodies 5' of the panel fitting parts 1'. To separate the parts 1' and 2', 2", the actuation part 6', or the tripping element 6 operatively connected to the actuation part 6', can be actuated; as a result the fixing means 7'. 7" are separated in releasing fashion from the bolts 3', 3".

Fundamentally, it can be provided according to the present invention that at least two tripping elements 6 are provided; each tripping element 6 releases one of the fixing means 7', 7" from one of the bolts 3', 3". Basically, an arbitrary number of fixing means and corresponding mounting parts 2, 2' can be provided can be provided on each of the panel fitting parts 1, 1'. Especially preferably, the individual fixing means can be released independently of one another in each of these embodiments.

FIG. 9 shows an embodiment of the fastening fitting 1, 1' of the invention, which is embodied with two fixing means 7', 7"; the individual fixing means are each operatively connected to a tripping element 18, 19. These elements are actuatable separately from one another, and each tripping element releases one of the fixing means from its connection to the respective bolt. In examples II through IV, the two tripping elements 18, 19 are shown in various situations. FIG. 9 II shows the two tripping elements 18, 19 in a first position, in which both fixing means 7', 7" are closed. FIG. 9 III shows the tripping element 18 in what, compared to its first position in FIG. 9 II, is a downward-deflected second position, as a result of which the upper fixing means 7" is opened. The corresponding motion of the individual parts is shown by the two arrows in FIG. 9 III. According to FIG. 9 III, when the movement of the tripping element 18 shown there takes place, the tripping element 19 remains in its first position as in FIG. 9 II, and the lower fixing means 7' remains in its closed state as in FIG. 9 II.

In FIG. 9 IV, the tripping element 18 remains in its first position as in FIG. 9 II, and the tripping element 19 is shifted downward into a second position. As a result of this shifting, the lower fixing means 7' is opened. The two motions, which are related to one another, of the tripping element 19 and the fixing means 7' are clearly indicated by the arrows shown in FIG. 9 IV. Fundamentally, the two tripping elements 18, 19 can be actuated simultaneously yet independently of one another.

As is shown especially clearly by a comparison of FIG. 9 II and FIG. 9 III, a displacement of the connection element 17 along a guide part, which can be embodied as an oblong slot 16, can be necessary to ensure a proper motion of the individual fixing means 7', 7". In a closed state, as shown for instance in FIG. 9 II, the connection element 17 is located in a region to the right of or in other words behind the guide part/oblong slot 16. When the fixing means is opened, as shown for instance in FIG. 9 III for the fixing means 7", the connection element 17 is displaced, together with the fixing means 7", to the left or into a forward region of the oblong slot 16.

In this variant embodiment, it can accordingly be said that the fixing means, for its motion between an open and a closed position, does not have any rotary axis with a fixed reference system but instead this is achieved with a guide part, inside which shifting of the fixing means is effected by a translational motion.

Above each fixing means, a projection 20 can be provided, which prevents the fixing means from being shiftable out of a closed to an open position merely by rotation of the fixing means about the connection element. According to the invention, securing, preferably in the form of the protrusion 20, can therefore exist, which enables the motion of the fixing means from a closed to an open position only whenever a translation of the connection element 17 at the fixing means, from a rear or in other words retracted position along the guide part/elongated hole 16 is effected to a forward position of the guide part 16/oblong slot. The forward position can be oriented toward the panel of the drawer.

An open position of a catch part can be present in particular whenever a bolt 3 is removable from a receptacle region of the catch part 7 and thus a connection between the panel fitting part 1' and the panel mounting part 2 can be released.

FIG. 9 I shows the tripping elements 18 and 19 relative to the panel fitting part 1' in an exploded view. The tripping elements 18 and 19 can each mutually serve as a rail-like guide for the other tripping elements, whereby actuation of both tripping elements, each in a lower region of the panel fitting part 1', is made possible. For that purpose, an actuation part 6' can be provided on each tripping element, which element can preferably be swung open.

FIG. 10 shows an embodiment of the panel fitting part 1' according to the invention in which, by means of a uniform tripping element 6, an uncoupled opening motion can be effected between the two fixing means 7', 7". FIG. 10 I shows the embodiment in an exploded view with a tripping element 6, on which an engagement element 21 that engages a spring 22 is provided; the spring 22 can act on the lower fixing means 7' directly or indirectly for opening the fixing means. In an upper region of the tripping element 6, there is an opening 23, which is connected to an actuating element for opening upper fixing means 7".

By means of a step-by-step actuation of the tripping element 6, in succession the lower fixing means 7' can first be opened into a first position downward by a motion of the tripping element 6, and then the upper fixing means 7" can be opened by a further motion of the tripping element 6 into a second position, which is preferably still farther downward than the first position, compared to an outset position, as shown in FIG. 10 II. The respective motion of the tripping element 6, and the resultant opening of the individual fixing means 7', 7" one after the other, are shown in FIG. 10 III through V by the arrows at the tripping elements and the fixing means.

A joint release of the two fixing means 7', 7" by actuation of the shared tripping element 6 from its respective bolts, or in other words from its closed position to an opened position, is thus avoided by means of the embodiment of FIG. 10 I through V.

The means for adjusting the inclination include an elongated guide plate 8, located vertically on the panel fitting part 1'; the end 9' of the guide plate 8 and the adjusting body 5', respectively, can be placed in alternation on end contact faces 4', 4" of the panel mounting part 2' and an additional panel mounting part 2" located above that panel mounting part, and one end of the guide plate 8 is connected to an adjusting body 5'. The guide plate 8 is provided in the middle with an elongated hole 10, in which a slide bolt 11 is displaced. By rotating the adjusting body 5', embodied as an eccentric bolt, about its axis **5*a*', as seen in FIG. 8 either the lower panel mounting part 2' or the upper panel mounting part 2" is adjusted, and thus swiveling of the panel about the slide bolt 11, acting as an axis, either up or down is effected. The adjusting body 5', for this purpose, is guided by a recess in the guide plate 8 on its one end 9 and is supported in the panel fitting part 1'; the adjusting body 5' also serves as an operational surface for generating the displacement force on the end contact face 4' of the panel mounting part 2'. The guide plate 8 furthermore, on its other end 9', has a part that is angled by 90°, which likewise serves as an operational surface for generating the displacement force on the end contact face 4" of the panel mounting part 2"**.

The axis **5*a*, 5*a*'** of the adjusting body and the swivel axis of the panel extend parallel to the base or cover side of the drawer, and the panel, for its optimal adjustment and alignment with the body of the cabinet, is pivotable about an angle of up to +/−5 degrees.

LIST OF REFERENCE NUMERALS

1, 1' Panel fastening fitting
2, 2', 2" Panel mounting part
3, 3', 3" Fastening bolts
4 Fork
4', 4" Middle/end contact faces
5, 5' Adjusting body/eccentric bolt
**5*a*** Axis
6 Tripping element
6' Actuation part
7 Fixing means
8 Guide plate
9, 9' End
10 Elongated hole
11 Sliding bolt
12 Screws
13 Bores
14 Angled regions
15 Adjusting bodies
16 Oblong slot as a slide bearing
17 Connection element
18 First tripping element
19 Second tripping element
20 Projection
21 Engagement
22 Spring
23 Opening

The invention claimed is:

1. A fastening fitting for a drawer panel, wherein the panel on its back side has aligned panel mounting parts (2, 2', 2"), and the side walls of the drawer have panel fitting parts (1, I') that receive the panel mounting parts (2, 2', 2"), which are connectable by means of fixing means (7, 7', 7") of the panel fitting parts (1, I') and fastening bolts (3, 3', 3") of the panel mounting parts (2' 2" 2")' characterized in that the panel mounting parts (2, 2', 2") have means (4, 4', 4", 8) for adjusting the inclination of the panel, which means are operatively connected with adjusting bodies (5, 5') of the panel fitting parts (1, I') and pivot the panel about an axis extending parallel to a base or cover side of the drawer, and that the fixing means (7', 7") are each displaceably located in a guide part and are movable along the guide part between an open position of the fixing means (7', 7") and a closed position of the fixing means (7', 7"); and wherein the means for adjusting the inclination include a fork (4) of the panel mounting part (2), which fork is oriented toward the panel fitting part (2), wherein each adjusting body (5,5') is embodied as an eccentric bolt, which fork receives the eccentric bolt (5).

2. The fastening fitting of claim 1, characterized in that the axis (Sa, Sa') of the adjusting body and the pivot axis of the panel run parallel.

3. The fastening fitting of claim 1, characterized in that the panel is pivotable about an angle of up to +/−5 degrees.

4. The fastening fitting of claim 1, characterized in that the panel mounting parts (2, 2', 2") are adjustable vertically relative to the panel fitting parts (1, I').

5. The fastening fitting of claim 1, characterized in that the panel mounting parts (2, 2', 2") are adjustable horizontally relative to the panel fitting parts (1, I').

6. The fastening fitting of claim 1, characterized in that at least one tripping element (6) for releasing the connection between fixing means (7', 7") and the panel mounting part (2, 2', 2") is provided on the panel fitting part (1, I').

7. The fastening fitting of claim 1, characterized in that the panel fitting part (1, I') has at least two fixing means (7', 7"), and the individual fixing means can be released by means of separate tripping elements (6).

8. The fastening fitting of claim 1, characterized in that by actuation of an individual tripping element (6) on a panel fitting part (1, I'), the connections between at least two panel mounting parts (2, 2', 2") and the respective catch parts (7', 7") of the panel fitting part can be released, and an uncoupling device is operatively connected to the tripping element (6) and is embodied for releasing the individual connections between catch parts (7', 7") and mounting parts in a delayed or chronologically staggered fashion relative to one another.

9. A fastening fitting for a drawer panel, wherein the panel on its back side has aligned panel mounting parts (2, 2', 2"), and the side walls of the drawer have panel fitting parts (1, I') that receive the panel mounting parts (2, 2', 2"), which are connectable by means of fixing means (7, 7', 7") of the panel fitting parts (1, I') and fastening bolts (3, 3', 3") of the panel mounting parts (2' 2" 2")' characterized in that the panel mounting parts (2, 2', 2") have means (4, 4', 4", 8) for adjusting the inclination of the panel, which means are operatively connected with adjusting bodies (5, 5') of the panel fitting parts (1, I') and pivot the panel about an axis extending parallel to a base or cover side of the drawer, and that the fixing means (7', 7") are each displaceably located in a guide part and are movable along the guide part between an open position of the fixing means (7', 7") and a closed position of the fixing means (7', 7"); and wherein the means for adjusting the inclination include an elongated guide plate (8), located vertically on the panel fitting part (I'); the adjusting body (5'), and one end (9') of the guide plate (8), respectively, can be placed in alternation on end contact faces (4', 4") of the panel mounting part (2') and an additional panel mounting part (2") located above it; and a second end (9) of the guide plate (8) is connected to the adjusting body (5').

10. The fastening fitting of one of claims claim 9, characterized in that the adjusting body (5') is guided through a recess of the guide plate (8) on its one end (9) and is supported in the panel fitting part (I'); and that the guide plate (8), on its second end (9') has a part bent at an angle of 90°.

* * * * *